US005401321A

United States Patent [19]

Hugo et al.

[11] Patent Number: 5,401,321

[45] Date of Patent: Mar. 28, 1995

[54] METHOD FOR CLEANING MATERIAL CONTAMINATED WITH GREASY OR OILY SUBSTANCES

[75] Inventors: Franz Hugo, Aschaffenburg; Johannes Mosch, Alzenau; Erwin Wanetzky, Grosskrotzenburg, all of Germany

[73] Assignee: Leybold Aktiengesellschaft, Hanau, Germany

[21] Appl. No.: 221,184

[22] Filed: Mar. 31, 1994

Related U.S. Application Data

[63] Continuation-in-part of Ser. No. 861,191, Mar. 31, 1992, abandoned.

[30] Foreign Application Priority Data

Nov. 11, 1991 [DE] Germany ..... 41 36 990.4

[51] Int. Cl.[6] ..... B08B 5/04; C23G 5/00

[52] U.S. Cl. ..... 134/11; 134/19; 134/21; 134/31; 134/40

[58] Field of Search ..... 134/11, 19, 21, 40, 134/31

[56] References Cited

U.S. PATENT DOCUMENTS

| | | | |
|---|---|---|---|
| 4,032,033 | 6/1977 | Chu et al. | 134/11 |
| 4,098,005 | 7/1978 | Wiarda | 134/11 |
| 4,141,373 | 2/1979 | Kartanson et al. | 134/21 |
| 5,114,495 | 5/1992 | Mainz | 134/11 |

*Primary Examiner*—Melvyn J. Andrews
*Assistant Examiner*—Zeinab El-Arini
*Attorney, Agent, or Firm*—Felfe & Lynch

[57] ABSTRACT

The parts are heated by conduction and radiation while the chamber is evacuated, whereupon the chamber is sealed air-tight and the parts are also heated by condensation of vapors from the grease and oil. When the parts reach a constant temperature the chamber is again evacuated, causing the temperature of the parts to drop as condensate thereon evaporates. Finally, the chamber is returned to atmospheric pressure and the cleaned parts are removed.

10 Claims, 3 Drawing Sheets

METHOD FOR CLEANING MATERIAL CONTAMINATED WITH GREASY OR OILY SUBSTANCES

BACKGROUND OF THE INVENTION

The application is a continuation-in-part of U.S. application Ser. No. 07/861,191, filed Mar. 31, 1992, now abandoned.

The invention relates to a method for cleaning material contaminated with greasy or oily substances in a vacuum chamber. The chamber is equipped essentially with a heater, a vacuum pump set, a flooding valve, and a system for measuring temperature and pressure.

Before any reprocessing of mechanical components such as automotive transmissions, removal of lubricant residues is one of the most urgent problems. The cleaning and degreasing of gears, Cardan joints, cylinder blocks, etc., is essential to any subsequent processing. Cleaning in this case means primarily the elimination of lubricants. The components to be cleaned must be dry after they are cleaned, i.e., the technical surfaces must be free of grease or oil coatings so that they can be used in further regeneration processes, such as grinding. These lubricants would at least have a great effect on the grinding process if not render it impossible.

The cleaning processes that have long been in use, whereby components contaminated mostly with lubricants are cleaned, are based on the use of grease dissolving substances, chiefly perchlorinated, trichlorinated or tetrachlorinated compounds. For sanitary and environmental reasons, the use of perchlorates in cleaning establishments is limited by law and is subject to strict safety requirements. Also in cleaning processes of this kind large amounts of highly toxic, inseparable liquids are formed, which due to their partially unknown composition have long had to be dumped.

In addition to the problem of disposing of wastes, the recyclability of the contaminated articles and substances is important. Mechanical parts which have been given a great surface hardness by thermochemical processes can suffer by subjection to high treatment temperatures in cleaning processes. The reuse of components thus treated is therefore doubtful.

In addition to washing processes, so-called vacuum cleaning processes are also known. U.S. Pat. No. 5,137,581 describes a three-step cleaning process which calls for heating the oil-contaminated object in a chamber, then spraying it with a cleaning fluid, and finally removing the oil residues from the chamber by evacuation. The operating pressure of this apparatus is within a range from several to 500 torr (1 torr corresponds to 1.33 hPa). As the specification says, operating at pressures less than several torr increases the cost of the pumping system so as not to be practical.

In an article by Wayne Mitten, "Vacuum Deoiling for Environmentally Safe Parts Cleaning" in the September 1991 issue of Metal Finishing, a method using a hot-wall chamber oven is described as follows:

1. Load oily or greasy parts into a chamber.
2. Select the auto cycle to remove oil and initiate.
3. Evacuate the chamber and heat the parts to the vapor temperature.
4. Collect the evaporated oil in a condenser system.
5. Backfill chamber to cool parts and return the chamber to atmospheric pressure.
6. Remove the clean parts.

7. Periodically defrost the condenser and remove the oil.

These long-known methods recognize the poor transmission of heat in a vacuum; the fats and oils are vaporized by directly heating the articles to be cleaned, and then removing vapors from the process chamber and delivering them to a condenser.

The invention offers a method for cleaning materials contaminated with greasy and/or oily substances, in which the articles to be cleaned undergo no physical and chemical alteration and are suitable for recycling. The economy is noticeably improved over known processes, and a fairly complete recovery of the lubricants which adhere to the articles is achieved. No environmentally objectionable solvents are used, and the amount of residue to be disposed of is minimal.

SUMMARY OF THE INVENTION

The invention offers a process which improves especially the convection of heat in a vacuum by utilizing the heat of condensation of the fats and oils for the transfer of heat to the parts being cleaned. For that purpose the vacuum chamber is first heated to the working temperature, the contaminated objects are placed on carriers and loaded in the heated chamber, and the chamber is evacuated and then sealed. In the chamber now sealed absolutely air-tight, in which the connection to the condenser is closed, the objects are now heated to a maximum surface temperature. Heating is accomplished by conduction through the carriers, by radiant heat from the chamber walls, and by heat of condensation until an equilibrium is reached between the temperatures of the grease and oil vapor on the one hand and the material being treated. Then the chamber is again evacuated through the condenser connected to the vacuum pump set until a total residual pressure of less than 1 hPa is reached. Then the chamber is disconnected from the pump set and flooded, so that the cleaned articles can be removed from the chamber.

Advantageously, the cleaning process according to the invention is successful without the addition of any adjuvants, so that no cleaning agents of any similar or different nature have to be added. This process thus replaces all of the cleaning processes known heretofore based on, for example, FCKW's, CKW's and aqueous lyes. The process of the invention is used to advantage in the recycling of, for example, Perbunan, Viton, PTFE, silicones, or for castings and steel parts before they are further processed or melted down to recover the alloy components. Furthermore, it is conceivable to apply the method to oily granular materials, sands and dusts.

DETAILED DESCRIPTION OF THE PREFERRED EMBODIMENT

Figure 1:
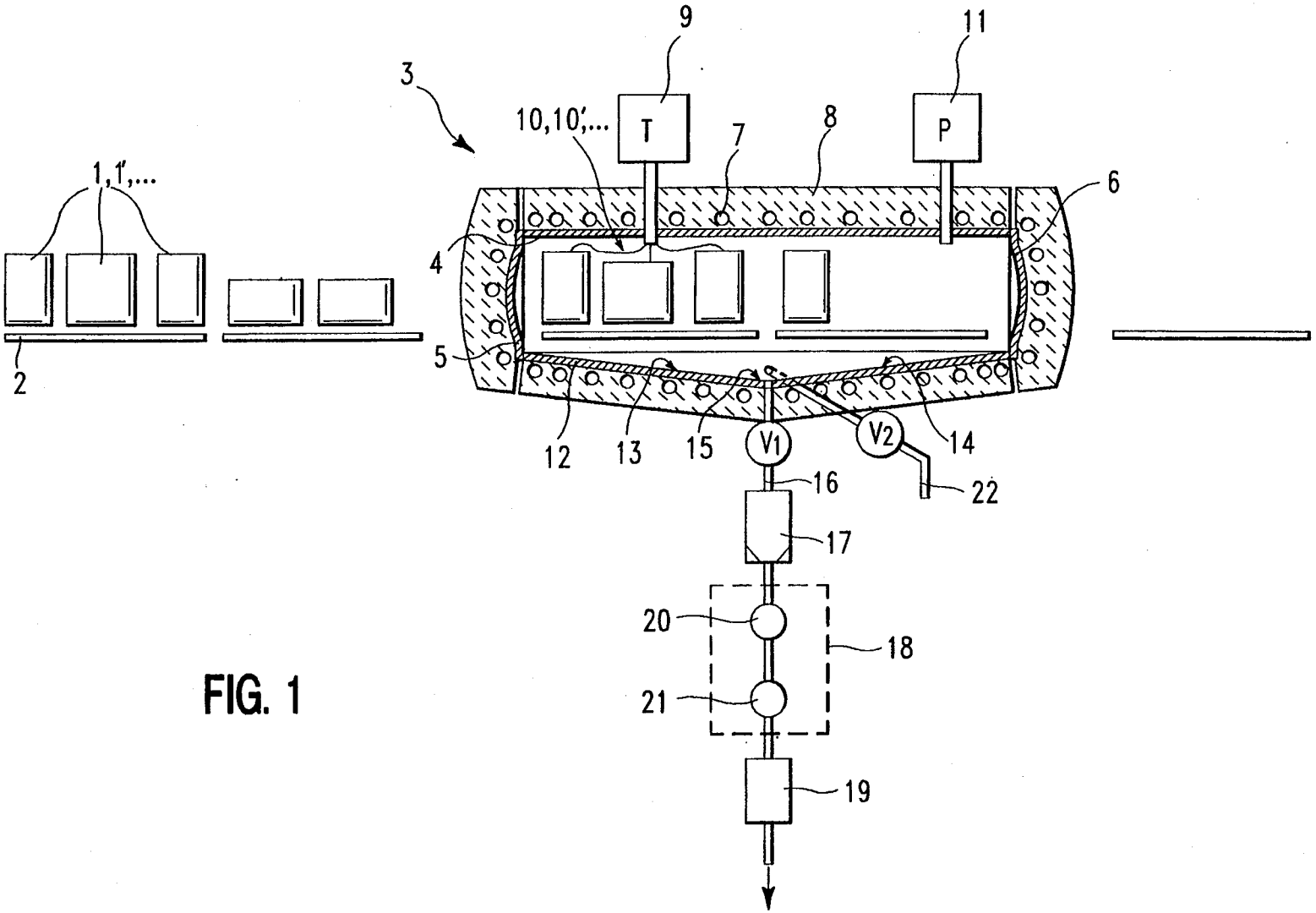
FIG. 1 is a schematic representation of the components of the apparatus necessary for the method, FIG. 2 a typical temperature curve for a cycle of treatment, represented graphically, FIG. 3 a typical pressure curve for a cycle of treatment, represented graphically.

Referring to FIG. 1, the objects 1, 1' to be treated are loaded on carriers 2 before they enter the treatment chamber. The vacuum chamber 3 is a substantially hollow-cylindrical body 4, which is disposed horizontally, and whose ends are closed by a loading gate 5 and an unloading gate 6. The chamber body 4 is in the form of a hot-wall tank on whose outside chamber wall a heater wire 7 is provided which is surrounded by insulation 8.

A temperature measuring device 9 is passed through the wall of chamber 3 into the chamber interior. This measuring device 9 is equipped with a plurality of temperature sensors 10, 10' . . . which detect the surface temperature of the objects 1, 1' . . . being treated. Also, a pressure gauge 11 is provided which detects the pressure P in the interior of the chamber 3.

The floor 12 of the vacuum chamber 3 has two ramps 13 and 14 having their lowest point at an outlet opening 15 approximately in the center of the chamber. The outlet opening 15 is connected to a condensor or collecting tank 17 by the drainage and suction line in which a valve $V_1$ is disposed. The tank 17 is evacuated to atmosphere via a vacuum pump set 18 and a gas filter or scrubber 19. The vacuum pump set 18 is composed essentially of a Roots blower 20 and a forepump 21.

An additional line 22 passes through the chamber floor 12 and ends inside of the vacuum chamber 3. A flooding valve $V_2$ is built into the line 22.

Figure 2:
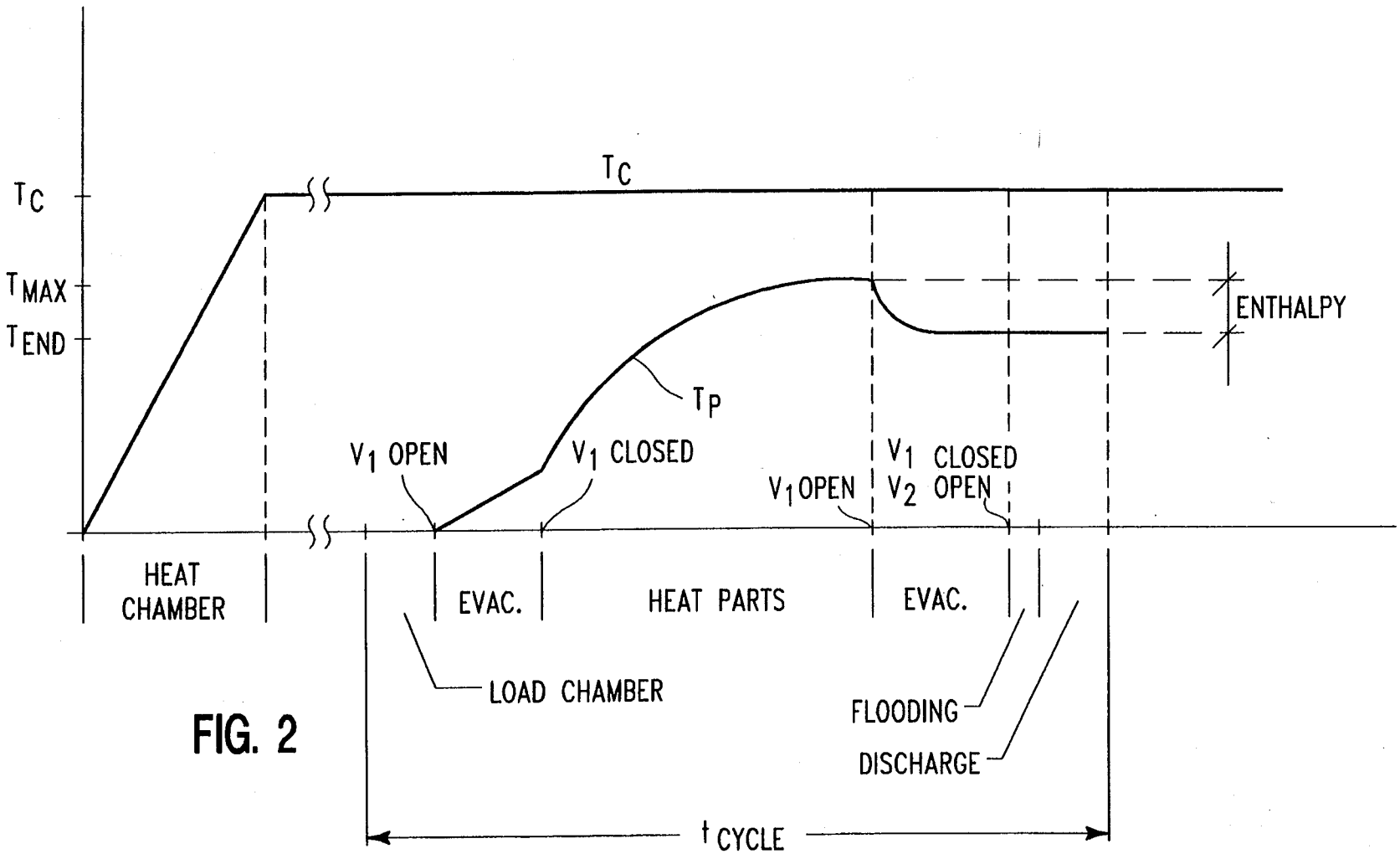

FIG. 2 shows by way of example two temperature curves, namely the temperature of the chamber $T_c$ and the temperature $T_p$ that establishes itself on the surface of the part being treated. The temperature of the chamber rises at first linearly from room temperature during the heating phase, until a maximum chamber temperature is established. This temperature is ideally kept at a constant level.

After the chamber temperature has reached its constant level, a typical process cycle begins, which can be repeated as often as desired. This cycle is composed of a number of individual steps succeeding one another in time:

(1) Loading the vacuum chamber with the articles to be cleaned. The temperature $T_p$ of the articles is still the room temperature.

(2) Valve $V_1$ is opened and the vacuum chamber is evacuated. $T_p$ rises from room temperature to a higher temperature level (100°to 400° C.) by conduction and radiation.

(3) $V_1$ is closed and the chamber is now absolutely air-tight. The parts are also heated by condensation of vapors and $T_p$ rises steeply then it asymptotically approaches a maximum $T_{max}$.

(4) $V_1$ is opened and the chamber is evacuated again down to a residual total pressure. $T_p$ drops and asymptotically approaches an end level $T_{end}$. The liquid fraction of the fats and oils drains by gravity out of the tank into the collecting tank. The vapor following is then condensed in the condenser and the noncondensable gases are sucked out of the chamber by the running pump set. The enthalpy of the objects being cleaned, metal parts for example, is sufficient to evaporate any thin lubricant coating remaining on the parts.

(5) $V_1$ is closed, $V_2$ is opened, the vacuum chamber is flooded with air and unloaded. The temperature remains approximately at the end temperature $T_{end}$.

Figure 3:
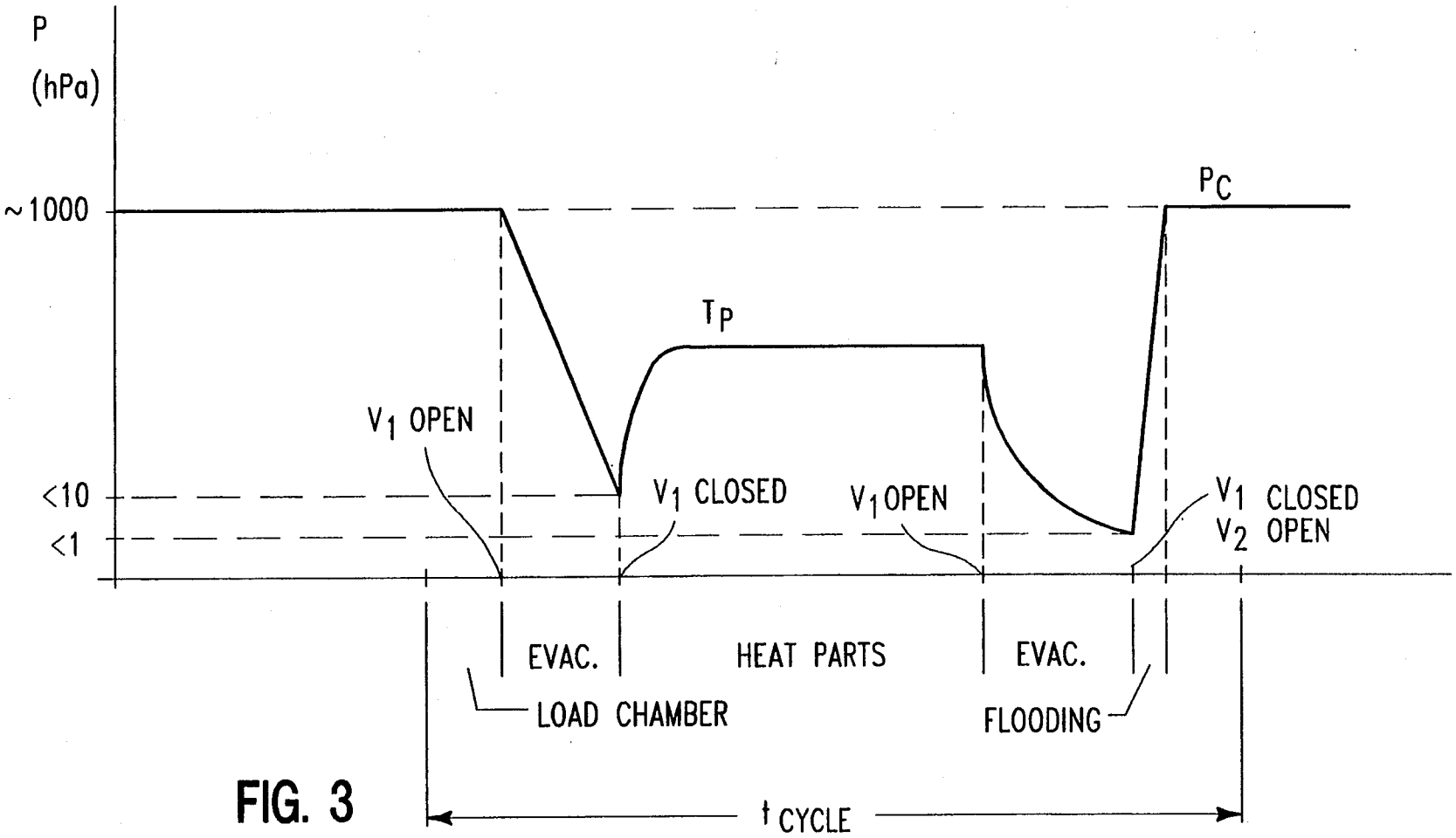

FIG. 3 shows the pressure $P_c$ in the chamber during the time frame represented in FIG. 2. It begins at atmospheric pressure of about 1000 hPa and remains constant while the chamber is being loaded, and then runs as follows:

(1) $V_1$ is opened, the chamber is evacuated, and the pressure drops to a level of less than 10 hPa. One hPa is one hecto pascal of 100 pascals.

(2) $V_1$ is closed and the heating begins. The pressure rises steeply and then remains about constant at the vapor pressure $P_v$ of the fats and oils.

(3) $V_1$ is opened, the chamber is evacuated. The pressure falls to a value less than 1 hPa, which is called the residual total pressure.

(4) $V_1$ is closed, $V_2$ is opened, and the chamber is flooded. The chamber pressure then rises back to atmospheric and remains at that level until the next cycle starts.

In the materials bearing fats or oils an amount of adsorbed and absorbed water is usually to be expected. On this account only pressures above the triple point pressure are possible during the pre-evacuation; otherwise water would become ice, which could damage the vacuum pumps. In treating such moist charges (water content over 5%) the process of the invention is performed in two stages. Thus, an extra treatment precedes the process of the invention in order first to reduce the moisture content. In this treatment, at first the high latent heat of the water is utilized for the intensive and rapid preheating of the loaded materials and for liquefying the highly viscous, thick grease layer. After the grease coating drips off, the water vapor is removed from the system in a separate operation of evacuation and condensation. The rest of the process is then performed as already described in accordance with the invention.

The process of the invention can of course be performed by the batch method as well as by the in-line method. This means that the process can be performed both manually and in an automated manner.

We claim:

1. A method for cleaning parts contaminated with at least one of grease and oil, the method comprising placing parts contaminated with at least one of grease and oil in a vacuum chamber;

effecting a first evacuation of the chamber to a pressure or less than 10 hPa;

sealing the chamber air-tight while the pressure is less than 10 hPa;

heating the parts in the chamber while said chamber is sealed air tight, thereby forming vapors of said at least one of grease and oil, and effecting a second evacuation of the chamber to remove vapors of said at least one of grease and oil.

2. The method of 1 wherein said sealing takes place while said parts are being heated.

3. The method of claim 1 wherein said parts are heated until they attain a constant temperature, whereupon said second evacuation is effected.

4. The method of claim 3 wherein said constant temperature is the vaporization temperature of said at least one of grease and oil.

5. The method of claim 1 wherein said parts are heated by radiation.

6. The method of claim 5 wherein said vacuum chamber has heated walls, whereby grease and oil dripping from the parts vaporizes on the walls and condenses on the parts.

7. The method of claim 5 wherein said parts are heated to a temperature between 100° and 400° C.

8. The method of claim 1 wherein said parts are heated by conduction.

9. The method of claim 1 wherein the parts are heated by condensation of vapors on the parts.

10. The method of claim 1 wherein said chamber is evacuated to a pressure less than 1 hPa during said second evacuation.

* * * * *